US006120045A

United States Patent [19]

Rosko

[11] Patent Number: 6,120,045

[45] Date of Patent: Sep. 19, 2000

[54] JUVENILE WALKER

[75] Inventor: Michael Scot Rosko, Greenwood, Ind.

[73] Assignee: Cosco Management, Inc., Wilmington, Del.

[21] Appl. No.: 09/160,482

[22] Filed: Sep. 25, 1998

Related U.S. Application Data

[60] Provisional application No. 60/060,100, Sep. 26, 1997.

[51] Int. Cl.[7] ..... B62B 7/00

[52] U.S. Cl. ..... 280/87.051; 280/87.021

[58] Field of Search ..... 280/87.051, 87.021, 280/87.01, 87.041

[56] References Cited

U.S. PATENT DOCUMENTS

| | | | |
|---|---|---|---|
| D. 295,397 | 4/1988 | Brownlie et al. . | |
| D. 305,416 | 1/1990 | Rohrer et al. . | |
| 2,308,626 | 1/1943 | Reinholz . | |
| 2,537,909 | 1/1951 | Puddester . | |
| 3,145,048 | 8/1964 | Dowdy et al. . | |
| 3,788,695 | 1/1974 | Salem . | |
| 4,019,756 | 4/1977 | Ishida . | |
| 4,025,083 | 5/1977 | Saint . | |
| 4,045,045 | 8/1977 | Boucher et al. . | |
| 4,211,426 | 7/1980 | Motloch . | |
| 4,231,582 | 11/1980 | Moss . | |
| 4,359,242 | 11/1982 | Gerken et al. . | |
| 4,364,576 | 12/1982 | Kassai . | |
| 4,433,869 | 2/1984 | Payne, Jr. et al. . | |
| 4,503,943 | 3/1985 | Tsukui . | |
| 4,576,392 | 3/1986 | Quinlan, Jr. . | |
| 4,579,359 | 4/1986 | Schwartz . | |
| 4,615,523 | 10/1986 | Chen . | |
| 4,699,392 | 10/1987 | Ku | 280/87.051 |
| 4,759,098 | 7/1988 | Ko . | |
| 4,759,541 | 7/1988 | Chen . | |
| 4,776,415 | 10/1988 | Brice . | |
| 4,795,151 | 1/1989 | Mulcaster . | |
| 4,799,700 | 1/1989 | Knoedler et al. | 280/87.051 |
| 4,822,030 | 4/1989 | Cone . | |
| 4,844,209 | 7/1989 | Sedlack . | |
| 4,903,960 | 2/1990 | Caffrey . | |
| 4,988,138 | 1/1991 | Danna et al. . | |
| 5,040,641 | 8/1991 | Phillips et al. . | |
| 5,054,851 | 10/1991 | Chiu . | |
| 5,056,805 | 10/1991 | Wang . | |
| 5,080,383 | 1/1992 | Hsieh . | |
| 5,112,044 | 5/1992 | Dubats . | |
| 5,203,581 | 4/1993 | Jankowski . | |
| 5,244,443 | 9/1993 | Cerda . | |
| 5,324,064 | 6/1994 | Sumser et al. . | |
| 5,342,072 | 8/1994 | Prasad . | |
| 5,366,231 | 11/1994 | Hung . | |
| 5,371,922 | 12/1994 | Chern et al. . | |
| 5,449,185 | 9/1995 | Sykes . | |
| 5,564,724 | 10/1996 | Huang . | |
| 5,590,892 | 1/1997 | Hu . | |
| 5,732,961 | 3/1998 | Theodoropoulos | 280/87.051 |
| 5,813,681 | 9/1998 | Saint et al. . | |
| 5,865,451 | 2/1999 | Hu | 280/87.051 |

FOREIGN PATENT DOCUMENTS

WO 97/38887 10/1997 WIPO .

*Primary Examiner*—Paul N. Dickson
*Assistant Examiner*—Bryan Fischmann
*Attorney, Agent, or Firm*—Barnes & Thornburg

[57] ABSTRACT

A walker comprising a base unit, a support unit including a seat adapted to support a person, a frame unit coupled to the base unit and the support unit to suspend the support unit above the base unit, at least one bidirectional wheel coupled to the base unit, and at least one caster wheel coupled to the base unit and spaced apart from the bidirectional wheel, the base unit including a base member and a brake strip coupled to the base member, the brake strip including a brake portion formed to include first and second channel bodies.

26 Claims, 8 Drawing Sheets

JUVENILE WALKER

This claims priority under 35 U.S.C. §119(e) to U.S. Provisional Application No. 60/060,100 filed Sep. 26, 1997, which is hereby incorporated by reference.

BACKGROUND AND SUMMARY OF THE INVENTION

The present invention relates to juvenile walkers, and particularly to movement inhibitors for juvenile walkers. More particularly, the present invention relates to a system configured to detect and react to the presence of a ledge and inhibit movement of the walker past the ledge.

A walker is an apparatus that includes an elevated seat sized to receive a small child and a rolling base arranged to support the elevated seat. A child seated in the walker uses leg motion to roll the walker toward a destination. Examples of walkers are disclosed in U.S. Pat. Nos. 4,699,392 to Ku and 4,799,700 to Knoedler et al.

According to the present invention, a juvenile walker includes a base unit, a child support unit, and a frame unit coupled to the base and child support units to elevate the child support unit above the base unit. A pair of caster wheels is coupled to a rear end of the base unit and a pair of bidirectional wheels is coupled to a front end of the base unit. The caster wheels swivel in relation to the base unit. The bidirectional wheels are rigidly coupled to the base unit so that they are constrained to roll in only two directions in relation to the base unit.

In preferred embodiments, the base unit includes a rectangular base member, a pivot unit mounted inside a front end of the base member for pivotable movement about a pivot axis, and a brake strip coupled to a perimeter edge of the base member. The two caster wheels are coupled to the base member and the two bidirectional wheels are coupled to the pivot unit.

The first bidirectional wheel is coupled to a left end of the pivot unit, the second bidirectional wheel is coupled to a right end of the pivot unit, and the pivot axis passes through a center portion of the pivot unit so that the first bidirectional wheel lies on the left side of the pivot axis while the second bidirectional wheel lies on the right side of the pivot axis. Both bidirectional wheels are constrained to roll back and forth along straight motion lines that lie in spaced-apart parallel relation to the pivot axis of the pivot unit.

The brake strip is coupled to a perimeter edge of the base member. The brake strip includes a support portion made of a first material and a brake portion made of a second material that is softer than the first material. The brake portion is coupled to the support portion and includes a series of channel bodies defining channels. The channel bodies deform when the brake strip engages an edge or floor to inhibit movement of the walker.

Additional features of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
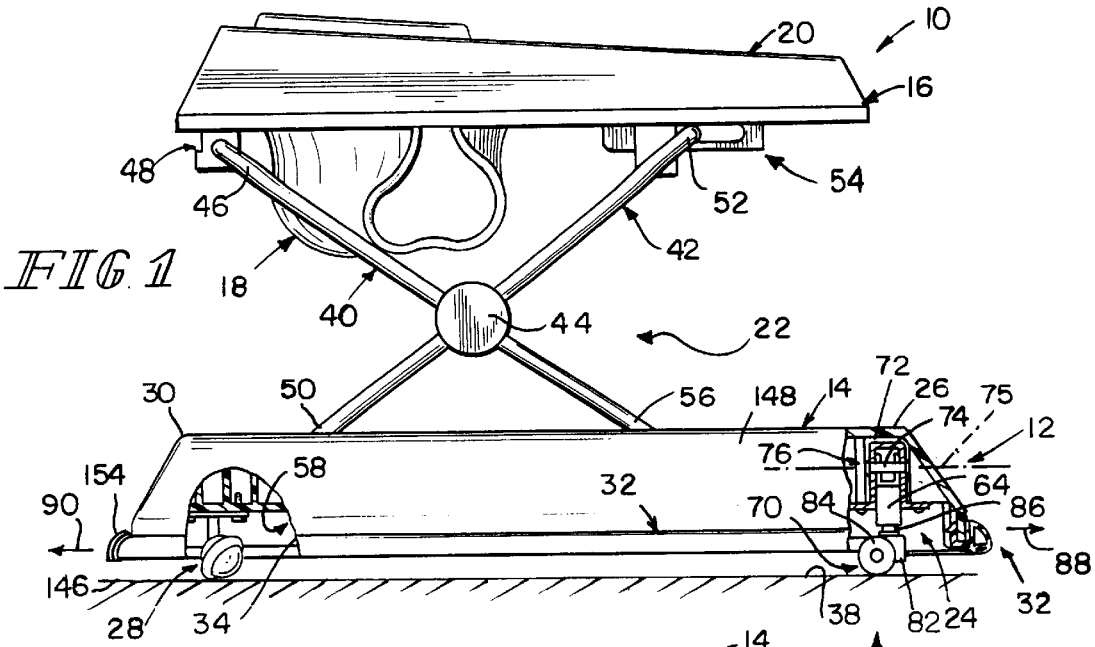
FIG. 1 is a side elevation view of a walker in accordance with a first embodiment of the present invention, with portions broken away, showing a base unit including a base member, a pivot unit coupled to the base member near the front of the walker, and a brake strip coupled to the underside of the base member, a caster wheel coupled to the base member near the rear of the walker, and a bidirectional wheel coupled to the pivot unit.

A walker 10 is configured to provide mobile seating for a toddler (not shown). Walker 10 includes a base unit 12, a child support unit 16, a frame unit 22, a pair of caster wheels 28, and a pair of bidirectional wheels 70. Support unit 16 is suspended above base unit 12 and is configured to include a seat 18 for supporting and positioning the toddler within walker 10. Support unit 16 includes a tray portion 20 that is positioned to lie generally in front of seat 18. Frame unit 22 is provided to suspend child support unit 16 at selected elevated positions above base unit 12.

Figure 2:
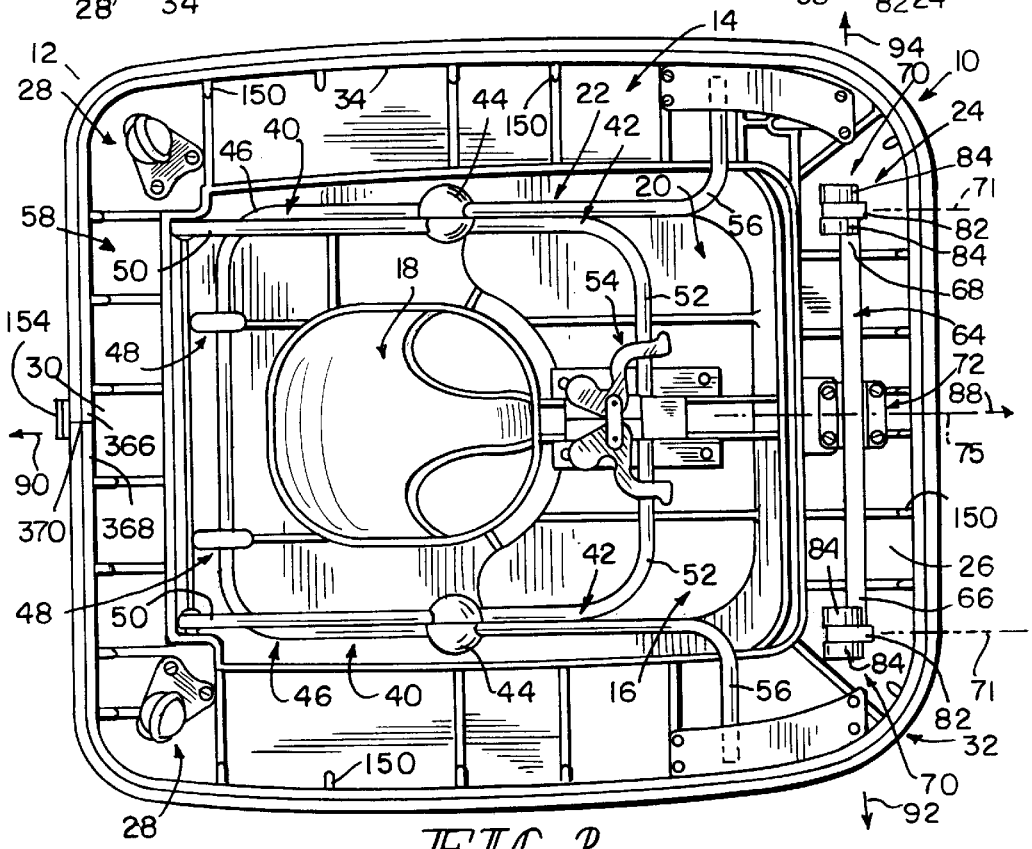
FIG. 2 is a bottom view of the walker of FIG. 1 showing two bidirectional wheels coupled to the pivot unit mounted on the front of the base member (on the right-hand side of FIG. 2), two caster wheels coupled to the rear of the base member (on the left-hand side of FIG. 2), and the brake strip coupled to a perimeter edge of the base member.
Figure 3:
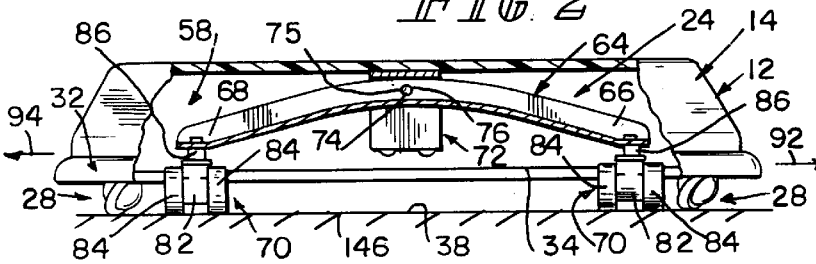
FIG. 3 is a front elevation view of the base unit of FIG. 1, with portions broken away, showing the two bidirectional wheels and the two rear caster wheels resting on a surface underlying the walker and showing a first of the bidirectional wheels being coupled to a left end of the pivot unit and a second of the bidirectional wheels being coupled to a right end of the pivot unit while a pivot axis passes through a center portion of the pivot unit.
Figure 4:
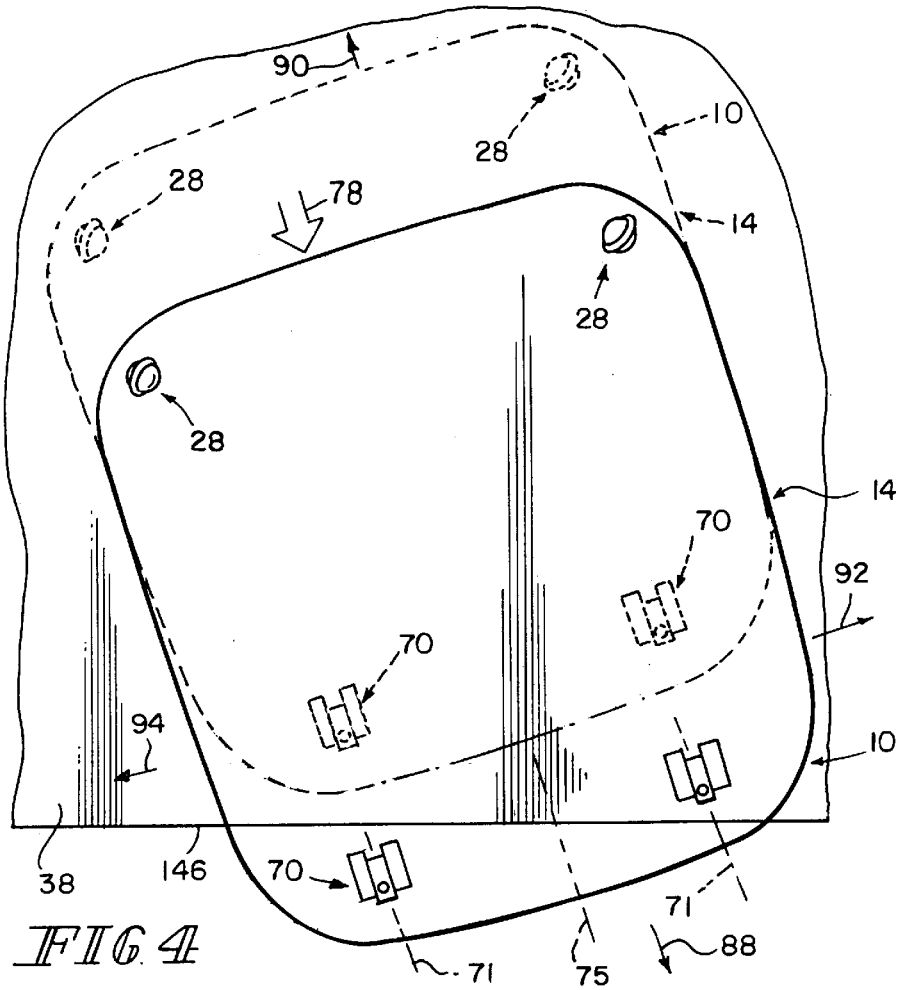
FIG. 4 is a diagrammatic plan view of the walker of FIG. 1 showing the walker (in phantom) oriented to present a front side of the base unit in a position facing toward an edge of a step before one of the bidirectional wheels rolls over the edge of the step and showing the walker (in solid) after one of the bidirectional wheels has rolled over the edge of the step following application of a force (represented by a double arrow) to the rear of the walker.
Figure 8:
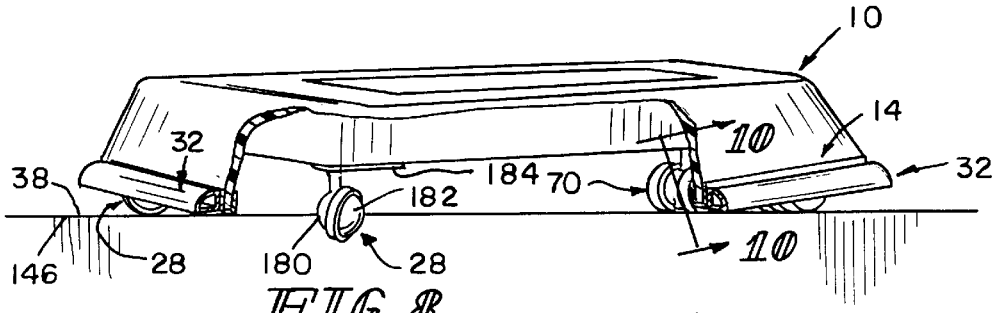
FIG. 8 is a side elevation view of the base unit of FIG. 7, with portions broken away, showing one of the caster wheels after it has rolled over the edge of the step leaving the bidirectional wheels and the other caster wheel in engagement with the step.
Figure 9:
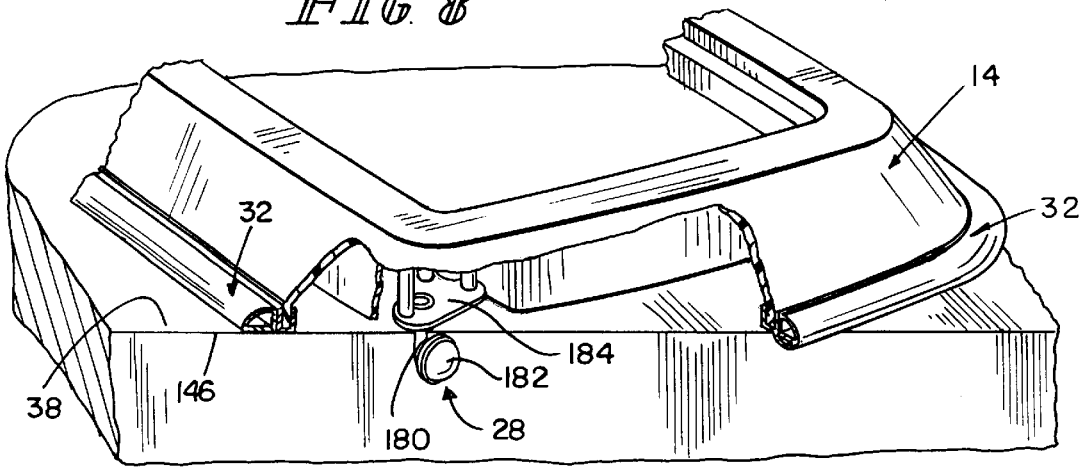
FIG. 9 is a perspective view of a portion of the base unit of FIG. 8, with portions broken away, showing the position of the caster wheel below the level of the surface and showing engagement of the brake strip in more than one location with the step.

Base unit 12 includes a shroud-like base member 14 which is somewhat rectangular in shape, a pivot unit 24 coupled to a front end 26 of base member 14, and a brake strip 32 coupled to a periphery 34 of base member 14 as shown best in FIGS. 2 and 3. Caster wheels 28 are coupled to a rear end 30 of base member 14 and bidirectional wheels 70 are coupled to pivot unit 24. Bidirectional wheels 70, caster wheels 28, and brake strip 32 cooperate to engage a surface 38 underlying walker 10 upon movement of bidirectional wheels 70 or caster wheels 28 over a step 36 or other drop in a floor or surface 38 so as to resist a further movement of walker 10 relative to step 36 or surface 38 as shown, for example, in FIGS. 4–6 and in FIGS. 7–9.

Caster wheels 28 are pivotably coupled to base member 14 so as to be free to swivel 360 degrees about a vertical axis of rotation relative to base member 14. Thus, caster wheels 28 not only roll over floor 38, but also swivel about an axis relative to base member 14 to enable caster wheels 28 to roll in many directions relative to base member 14.

Each bidirectional wheel 70 is constrained to roll back and forth along a straight motion line 71 that lies in spaced-apart parallel relation to a pivot axis 75 of pivot unit 24. That pivot axis 75 is established by pivot pin 74 as shown in FIGS. 1–3.

Caster wheels 28 and bidirectional wheels 70 are positioned so that when certain forces are applied to walker 10, walker 10 pivots in a predetermined direction. Caster wheels 28 roll over floor 38 and swivel relative to base member 14. Because of this configuration, walker 10 is constrained in how it moves in reaction to forces applied to walker 10. Because of the configuration of the caster and wheels 28 and bidirectional wheels 70, the front end of base unit 12 can only roll back and forth along a straight motion line 71 over floor 38 and will resist movement perpendicular to the straight motion line 71. However, the rear end of base unit 12 is supported by two swiveling caster wheels 28 and is free to roll in any direction. Thus, when an external force is applied to base unit 12 along a line perpendicular to the straight motion line 71, walker 10 will have a tendency to pivot about a vertical axis (e.g., axis 80) located near the front end of base unit 12 and arranged to pass through one of the bidirectional wheels 70.

Frame unit 22 includes first frame members 40 and second frame members 42 as shown, for example, in FIG. 1. First frame members 40 extend generally from a rear portion of support unit 16 toward a forward portion of base unit 12. Second frame members 42 extend generally from a forward portion of support unit 16 toward a rearward portion of base unit 12. Each first frame member 40 and second frame member 42 intersect and are coupled to one another at a point approximately near the centers of the members by a frame pivot member 44. First frame members 40 include upper ends 46 that are journaled for pivotal movement in pivot mounts 48 that are attached to the underneath side of the rear portion of support unit 16. Lower ends 50 of second frame members 42 are mounted for pivotal movement to the rear portion of base unit 12. Upper ends 52 of second frame members 42 are mounted to the underside of support unit 16.

A height-adjustment mechanism 54 functions to permit child support unit 16 to be moved relative to underlying base unit 12 to any one of a number of selected positions. For a detailed description of the structure and use of height-adjustment mechanism 54 reference is made to U.S. Pat. No. 4,359,242 to Gerken et al, the disclosure of which is hereby incorporated herein by reference in its entirety. Lower ends 56 of first frame members 40 are mounted in base member 14. Support for lower ends 56 of first frame members 40 are also described in U.S. Pat. No. 4,359,242 and in U.S. Pat. No. 4,799,700 to Knoedler et al, the disclosure of which is hereby incorporated herein by reference in its entirety.

Pivot unit 24, the pair of bidirectional wheels 70, and a pair of caster wheels 28 are positioned to lie in a cavity 58 formed in base member 14 as shown, for example, in FIGS. 1–3. The use of a pivoting support leg similar to pivot unit 24 is specifically described in U.S. Pat. No. 4,799,700 and U.S. Pat. No. 4,699,392 to Ku, the entire disclosure of which is hereby incorporated herein by reference.

The configuration of brake strip 32 is shown in greater detail in FIGS. 10 and 11 and will be discussed in greater detail below. Brake strip 32 is formed from a first material 60 that is made of plastic and a softer second material 62 that is a pliable friction material such as, for example, rubber or another suitable synthetic, rubber-like material.

Pivot unit 24 is mounted in cavity 58 on base member 14 as shown in FIGS. 2 and 3. Pivot unit 24 includes an arm 64 including a first end 66 and a second end 68. The first bidirectional wheel 70 is coupled to the left end 68 of arm 64 and the second bidirectional wheel 70 is coupled to the right end 66 of arm 64 as shown, for example, in FIG. 3. Arm 64 is mounted for pivotable movement on a bracket 72 that is attached to base member 14 in cavity 58.

Specifically, arm 64 is mounted for pivotable movement on bracket 72 about a pivot axis 75 by a pivot pin 74. As can be seen in FIG. 1, pivot pin 74 extends through a pair of holes 76 that are formed in the center of arm 64. By mounting arm 64 in holes 76, first and second ends 66, 68 are substantially equidistant from the pivot point 75 defined by pivot pin 74. Thus, pivot unit 24 is mounted for pivotal movement substantially near the center of arm 64 as shown, for example, in FIG. 3. Assuming that the center of gravity of walker 10 with respect to the side of walker 10 is located substantially near the center of the unit, the pivot unit 24 will thus pivot about a pivot point substantially near this lateral center of gravity of the device. This provides for increased stability of the unit when operating on a surface 38 underlying walker 10.

Figure 5:
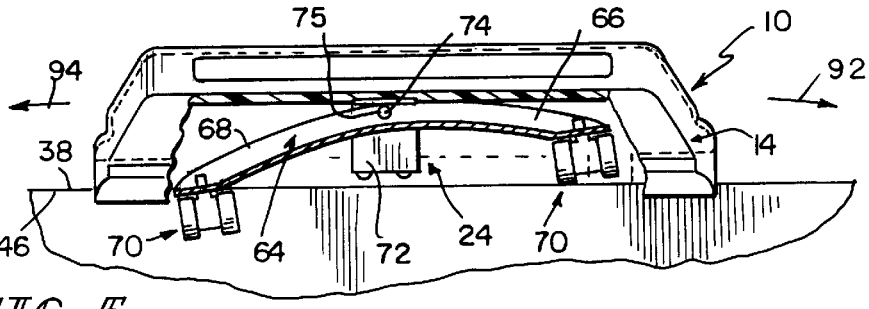
FIG. 5 is a front elevation view of the base unit of FIG. 4, with portions broken away, showing the counterclockwise pivoted movement of the pivot unit about its pivot axis after one of the bidirectional wheels has rolled over the edge of the step leaving the other bidirectional wheel in partial engagement with the step.
Figure 6:
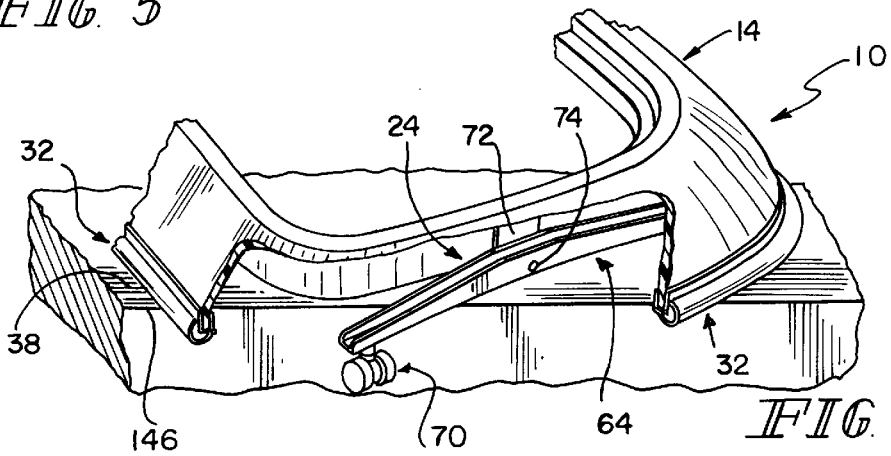
FIG. 6 is a perspective view of a portion of the base unit of FIG. 5, with portions broken away, showing the position of one of the bidirectional wheels below the level of the surface and showing engagement of the brake strip in more than one location with the step.

One bidirectional wheel 70 is mounted on each end 66, 68 of arm 64 and configured to permit rolling movement of walker 10 on surface 38. By providing a pivoting connection between base member 14 and pivot unit 24, when one of the bidirectional wheels 70 dips or otherwise moves over a step 36 to a position below the level of surface 38 or experiences a like drop in elevation, the other bidirectional wheel 70 lifts off of surface 38, as shown in FIGS. 5 and 6, for only partial engagement with surface 38. Thus, neither of bidirectional wheels 70 provides rolling motion between walker 10 and surface 38 when one of bidirectional wheels 70 rolls off step 36 and moves to a position below the level of surface 38. Therefore, a portion of brake strip 32 included in base unit 12 is in sliding or direct frictional contact with underlying surface 38 and inhibits further movement of walker 10 relative to underlying surface 38. Brake strip 32 will be discussed in more detail below.

Figure 7:
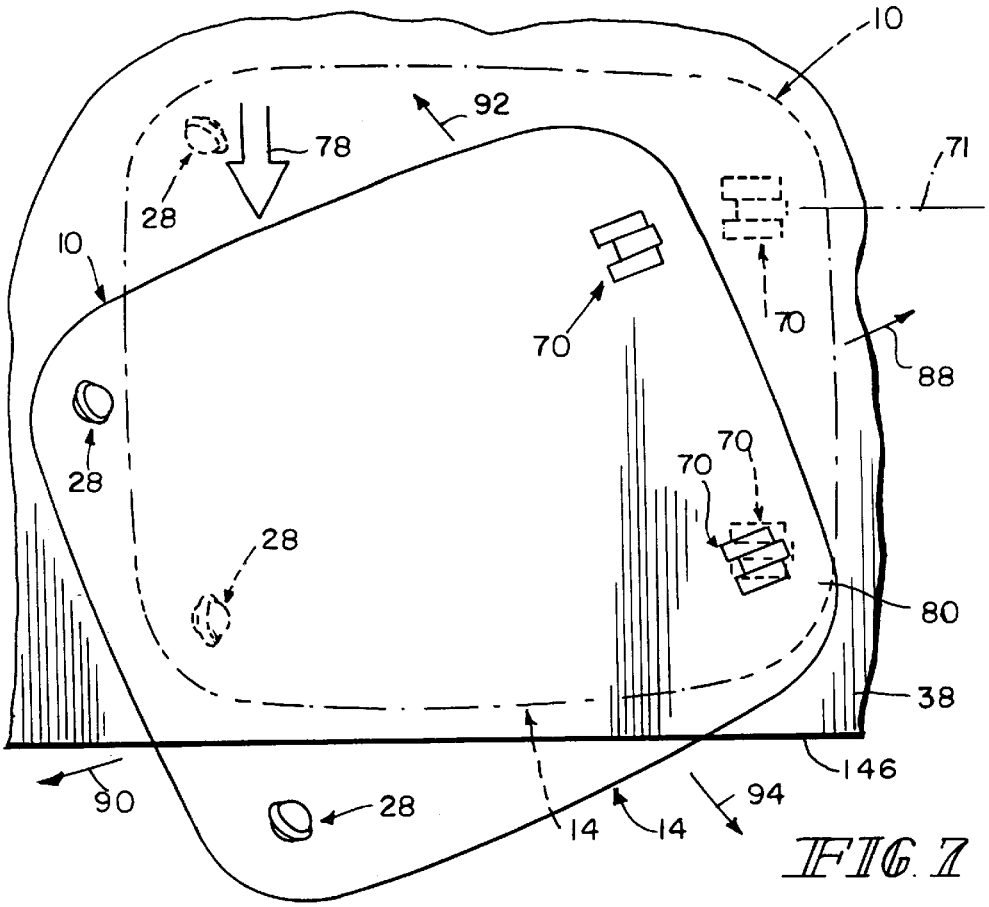
FIG. 7 is a diagrammatic plan view of the walker of FIG. 1 showing the walker (in phantom) oriented to present a left side of the base unit in a position facing toward the edge of the step before one of the rear caster wheels rolls over the edge of the step and showing the walker (in solid) after one of the rear caster wheels has rolled over the edge of the step following application of a force (represented by a double arrow) to the right side of the walker.

Base unit 12 also includes caster wheels 28 coupled to base member 14 so that portions of caster wheels 28 are free to swivel in relation to base member 14. Caster wheels 28 and bidirectional wheels 70 are configured so that if a force 78 is applied to the right or left side of walker 10 when the front side of walker 10 is perpendicular to step 36, as shown in FIG. 7, in phantom, walker 10 will pivot about a vertical axis 80 so that the front side of walker 10 is facing away from step 146 as shown, for example, in FIGS. 7–9, in solid.

To provide such an orientation, bidirectional wheels 70 are constrained to allow rolling motion in a substantially linear path and caster wheels 28 are configured to swivel. Each bidirectional wheel 70 includes a base 82, a pair of wheel members 84 rotatably coupled to base 82, and a shaft 86 attached to base 82 and ends 66, 68 of arm 64. Shaft 86 is rigidly attached to arm 64 and base 82 so that little or no rotational motion exists between base 82, arm 64, and base member 14. Thus, bidirectional wheels 70 are constrained to roll substantially only in directions 88, 90 along straight motion lines 71 perpendicular to the front of walker 10. Because bidirectional wheels 70 substantially only roll back and forth in directions 88, 90, the front side of walker 10 will not roll in directions 92, 94 perpendicular to the front side of walker 10 and directions 88, 90.

The front side of walker 10 will tend to move in directions 92, 94, if a large force is applied to walker 10 in directions 92, 94, respectively. Such motion requires bidirectional wheels 70 to slide in either direction 92, 94. To decrease the likelihood of such sliding, wheel members 84 are made of a softer durometer material to increase the tackiness and surface-gripping ability of bidirectional wheels 70 so as to limit such motion of the front side of walker 10 in directions 92, 94 relative to underlying surface 38. Such motion is also resisted by the use of multiple wheel members 84 on each bidirectional wheel 70. One or more such wheel members could be included in each of the bidirectional wheels 70.

One caster wheel 28 is coupled to the left rear underside of base member 14 and the other caster wheel 28 is coupled to the right rear underside of base member 14 as shown, for example, in FIG. 2. Each caster wheel 28 includes a support member 180, a caster wheel member 182 rotatably coupled to support member 180, a shaft 183 rotatably coupled to support member 180, and a support plate 184 rigidly attached to shaft 183 and base member 14. Caster wheel members 182 of each caster wheel 28 are thus rotatably coupled to base member 14 to swivel on shaft 183 in relation to base member 14. Therefore, caster wheel members 182 can roll in any direction on surface 38.

Because caster wheels 28 are capable of swivelling motion, force 78 applied in either directions 92, 94 will cause the back side of walker 10 to move in directions 92, 94, respectively. Thus, because the back side of walker 10 will roll when force 78 is applied in directions 92, 94 to walker 10 and the front side of walker 10 will not roll in directions 92, 94, the back side of walker 10 will pivot about axis 80. Thus, if walker 10 is positioned to lie so its right or left sides are substantially parallel to step 36 and force 78 is applied to walker 10 in direction 92 towards step 36, as shown in FIG. 7, the back side of walker 10 will pivot substantially about axis 80 in direction 96 toward step 36 until one of caster wheels 28 drops over step 36 below the level of surface 38. Thus, caster wheel 28 no longer provides rolling motion between walker 10 and surface 38 and a portion of brake strip 32 and base unit 12 is in sliding or direct contact with surface 38 and resists further movement of walker 10 relative to underlying surface 38.

Figure 18:
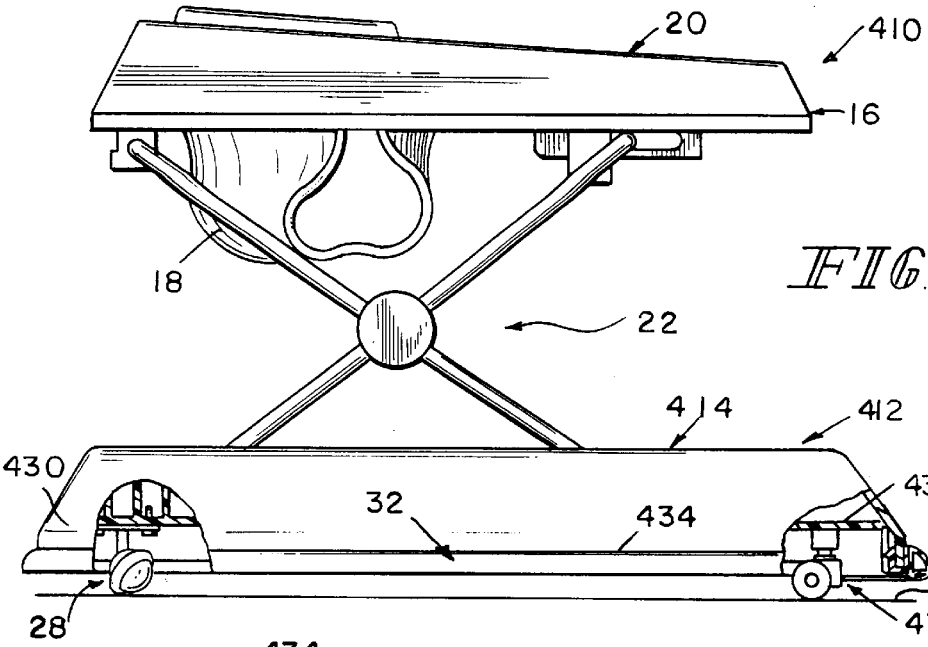
FIG. 18 is a side elevation view of a walker in accordance with a second embodiment of the present invention, with portions broken away, showing a base unit including a base member and a brake strip coupled to the periphery of the base member, a caster wheel coupled to the base member near the rear of the walker, a bidirectional wheel coupled to the base member near the front of the walker.
Figure 19:
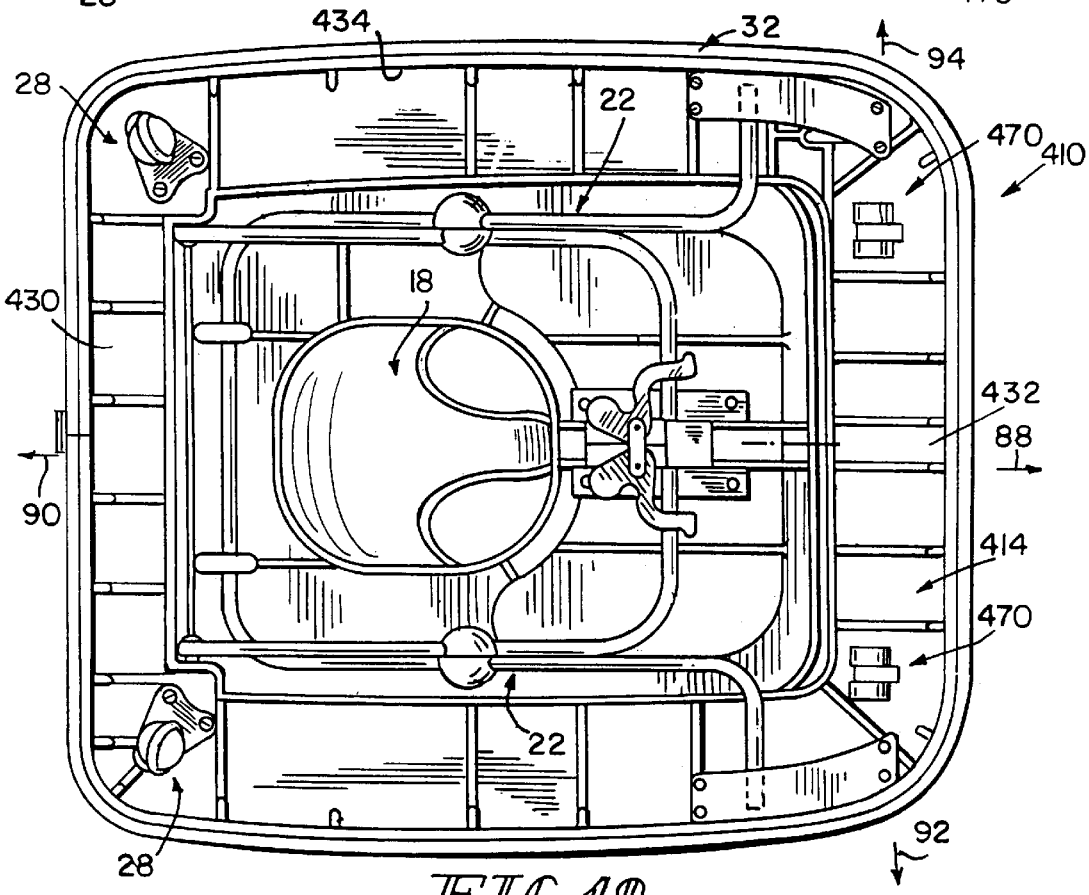
FIG. 19 is a bottom view of the walker of FIG. 18 showing two bidirectional wheels coupled to the front of the base member (on the right-hand side of FIG. 19), two caster wheels coupled to the rear of the base member (on the left-hand side of FIG. 19), and the brake strip coupled to a perimeter edge of the base member.
Figure 20:
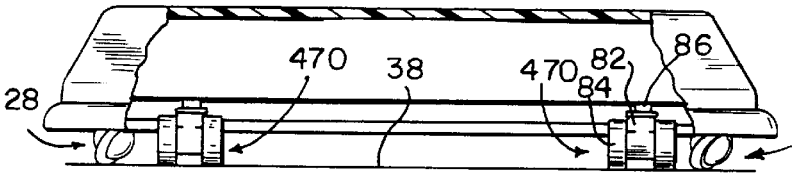
FIG. 20 is a front elevation view of the base unit of FIG. 18, with portions broken away, showing the bidirectional wheels and the caster wheels resting on a surface underlying the walker.

Walker 410 is also configured to provide mobile seating for a toddler (not shown) and is shown in FIGS. 18–20. Walker 410 includes a base unit 412, child support unit 16, frame unit 22, a pair of caster wheels 28, and a pair of bidirectional wheels 470. Child support unit 16 is suspended above base unit 412 and is configured to include seat 18 for supporting and positioning the toddler within walker 410. Although walker 410 includes two bidirectional wheels 470, it does not include a pivot unit such as the pivot unit 24 included in the walker 10 shown in FIGS. 1–9.

Base unit 412 includes a shroud-like base member 414 which is somewhat rectangular in shape and a brake strip 32 coupled to a periphery 434 of base member 414. Caster wheels 28 are coupled to a rear end 430 of base member 414 and bidirectional wheels 470 are rigidly coupled to a front end 432 of base member 414 as shown in FIGS. 18–20. Base member 414 may also be formed to include sockets (not shown) adapted to receive shaft 183 of caster wheel 28. By mounting shaft 183 in the socket, support plate 184 is no longer necessary.

Bidirectional wheels 470, caster wheels 28, and brake strip 32 cooperate to engage surface 38 underlying walker 410 upon movement of bidirectional wheels 470 or caster wheels 28 over step 36 or other drop in a floor or surface 38 so as to resist a further movement of walker 410 relative to step 36 or surface 38. Bidirectional wheels 470 are similar to bidirectional wheels 70 and move in a similar back and forth motion. Thus, like walker 10, walker 410 also pivots about an axis when external forces are applied to sides of walker 410 as described above.

Walker 10 includes brake strip 32 that is designed to resist and block motion of walker 10 relative to underlying surface 38 when either one of caster wheels 28 or bidirectional wheels 70 roll over step 36 below surface 38. Therefore, in case of such an event, base unit 12 will drop and brake strip 32 will likewise drop and contact surface 38 or an edge 146 of step 36 as shown, for example, in FIGS. 5, 6, 8, and 9. Such frictional contact will resist external forces applied to walker 10 or the motion of walker 10 to prevent or resist the motion of walker 10 toward step 36.

Figure 11:
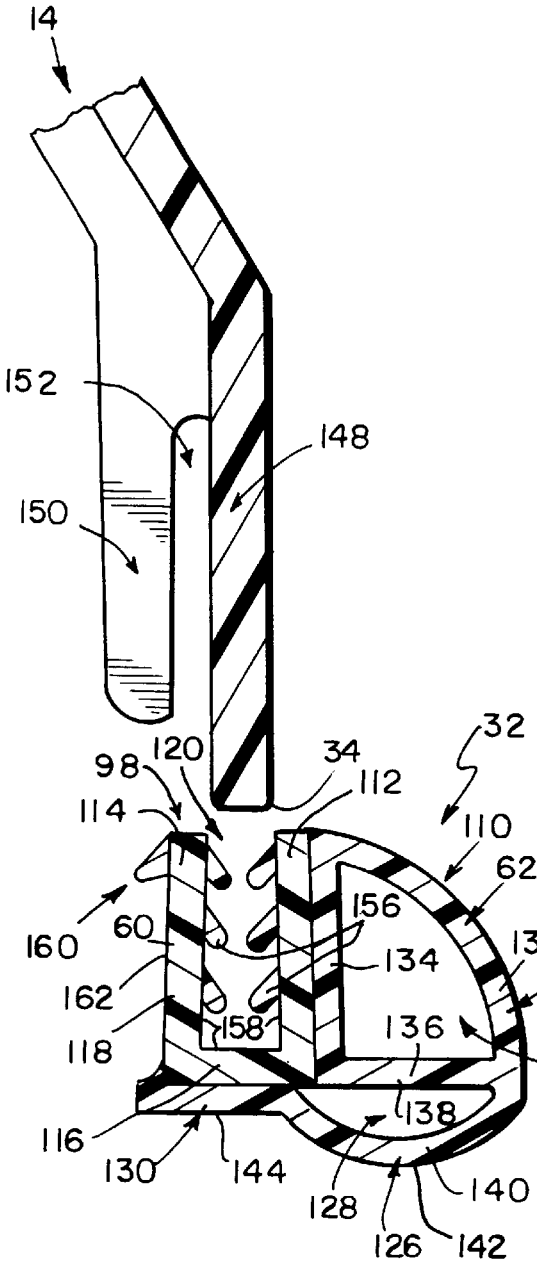
FIG. 11 is a view similar to FIG. 10 showing the brake strip and a portion of the base member prior to being mounted on to the base member.

Brake strip 32 is shown separated from base member 14 in FIG. 11. Brake strip 32 includes a first or support portion 98 made of first material 60 and a second or brake portion 110 made of second material 62. Support portion 98 includes a first side or outer wall 112, a second side or inner wall 114, and a bottom wall 116 which cooperates with outer wall 112 and inner wall 114 to form a groove body 118 defining a groove 120. Brake portion 110 includes a first channel body 122 defining a first channel 124, a second channel body 126 defining a second channel 128, and an extended body 130 extending from second channel body 126. First channel body 122 is coupled to outer wall 112, second channel body 126 is coupled to first channel 122, and extended body 130 is coupled to bottom wall 116 and second channel body 126.

First channel body 122 includes a first side wall 132, a second side wall 134 coupled to outer wall 112, and a bottom wall 136 as shown in FIG. 11. Second channel body 126 includes a top wall 138 coupled to bottom wall 136 of first channel body 122 and a bottom wall 140 including a bottom or first contact surface 142. Extended body 130 includes a bottom or second contact surface 144 and is coupled to bottom wall 116 of support portion 98 and bottom wall 140 of second channel body 126. First material 62 is a flexible material of approximately 50 "Shore-A" durometer and second material 60 is made of a more rigid material than first portion 98 of approximately 100 "Shore-A" durometer.

Because brake portion 110 of brake strip 32 is made of a soft low-durometer material, brake portion 110 conforms to more rigid objects applying force or pressure on brake portion 110. For example, as shown in FIG. 10, brake portion 110 of brake strip 32 yields and conforms to normal force being applied against brake strip 32 by edge 146 of step 36. Such conforming of brake portion 110 allows brake strip 32 to form mechanical-like gripping contact between edge 146 and base unit 12 in addition to the static and dynamic frictional contact caused by normal forces applied by edge 146. Such frictional forces would also act against brake strip 32 if the contact was with a surface such as surface 38.

The mechanical-like gripping contact and the frictional forces provide resistance to an external force 78 applied to walker 10. Such contact with edge 146 of step 36 or surface 38 and the resulting resistance to the applied force are components in stopping movement of walker 10 if one of the caster wheels 28 or bidirectional wheels 70 loses contact with surface 38. Such a condition could exist, for example, if one of the caster wheels 28 or bidirectional wheels 70 rolls over step 36 to move to a position below the level of surface 38 as shown, for example, in FIGS. 4–9.

First and second channel bodies 122, 126 of brake strip 32 permit additional cushioning and flexure of brake strip 32 when it contacts a surface such as edge 146 of step 36 or surface 38 to provide good braking characteristics to walker 10. First and second channel bodies 122, 126 increase the flexibility of brake strip 32 and allow brake strip 32 to conform more to edge 146 or surface 38 as shown, for example, in FIG. 10 to increase the mechanical-like gripping contact between walker 10 and edge 146 of step 36 or surface 38.

Likewise, first contact surface 142 is curved or bubble-shape as defined by second channel body 126. This curved shape surface 142 deforms when brake strip 32 engages edge 146 or surface 38. This deformation increases the area of contact of first contact surface 142 with edge 146 or surface 38. An increased area of contact increases the gripping of brake strip 32 to edge 146 or surface 38 and helps resists motion of walker 10 against forces applied to walker 10. Furthermore, by providing a curved shape to first contact surface 142, brake strip 32 provides more gripping contact between walker 10 and surface 38 or edge 146 in the event that one of caster wheels 28 or bidirectional wheels 70 were to roll over step 36. Similarly, because first and second channel bodies 122, 126 are flexible and deform when in contact with edge 146 or surface 38, extended body 130 engages edge 146 or surface 142, as shown in FIG. 10, and second contact surface 144 contacts edge 146 or surface 142 and further increases the area of contact of brake strip 32 and increases the gripping force.

Figure 10:
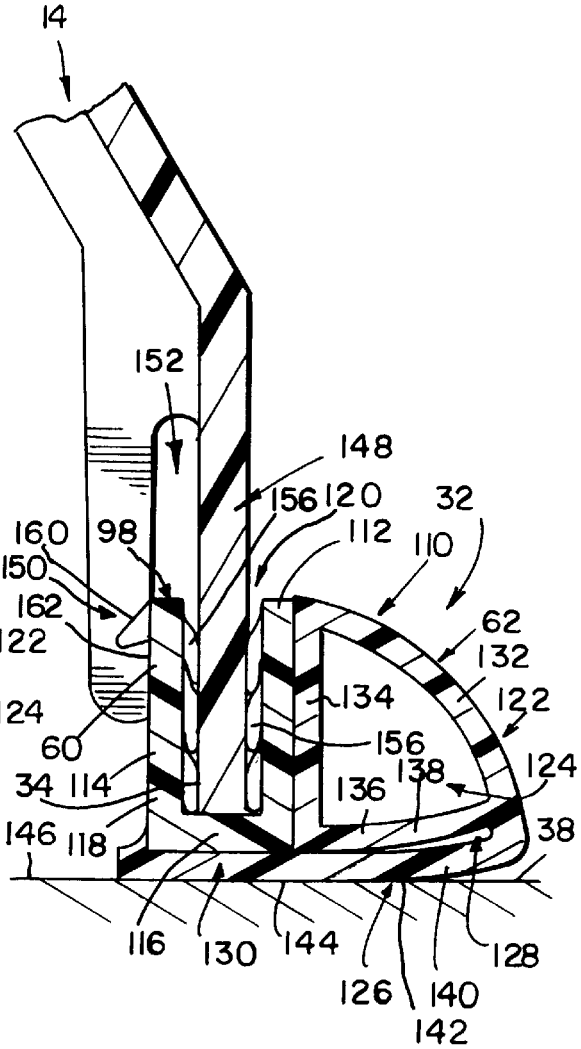
FIG. 10 is a cross-sectional view of the brake strip and a portion of the base member taken along line 10—10 of FIG. 8 showing the brake strip engaging the edge of the step after lowering of a portion of the base unit to the step-engaging position shown in FIGS. 6, 8 and 9.

The mounting of brake strip 32 on lower peripheral edge 34 of base member 14 is shown in greater detail in FIGS. 10 and 11. Specifically, base member 14 includes an outer wall 148, a series of inner tabs 150 which cooperate with outer wall 148 to form tab grooves 152, and a brake strip clip 154. As previously mentioned, brake strip 32 includes support portion 98 and brake portion 110 that is softer than support portion 98. Support portion 98 provides increased rigidity and forms a clip so that inner wall 114 of brake strip 32 can be "snapped" or "clipped" to hold on to base member 14 in a tight grip as shown in FIG. 10.

Brake portion 110 further includes a series of inner tabs 156 coupled to an inner surface 158 of groove body 118 that extend into groove 120 and an outer tab 160 coupled to an outer surface 162 of groove body 118 and extending away from inner wall 114 as shown, for example in FIG. 11. Inner and outer tabs 156, 160 conform to base member 14 when brake strip 32 is clipped on to base member 14. Inner tabs 150 of base member 14 and outer wall 148 wedge and compress inner and outer tabs 156, 160 of brake strip 32 as shown, for example, in FIG. 10. Thus, the rigidity of support portion 98 provides a clip-like connection to base member 14 and inner tabs 156 of brake strip 32 compress against outer wall 148 of base member 14 to form a compression connection to base member 14 that couples brake strip 32 to base member 14 without the use of adhesives. However, it is within the scope of this disclosure for adhesives to be used to couple the brake strip to the base member. Likewise, outer tab 160 compresses against inner tabs 150 to form a compression connection to base member 14 that also couples brake strip 32 to base member 14.

Figure 12:
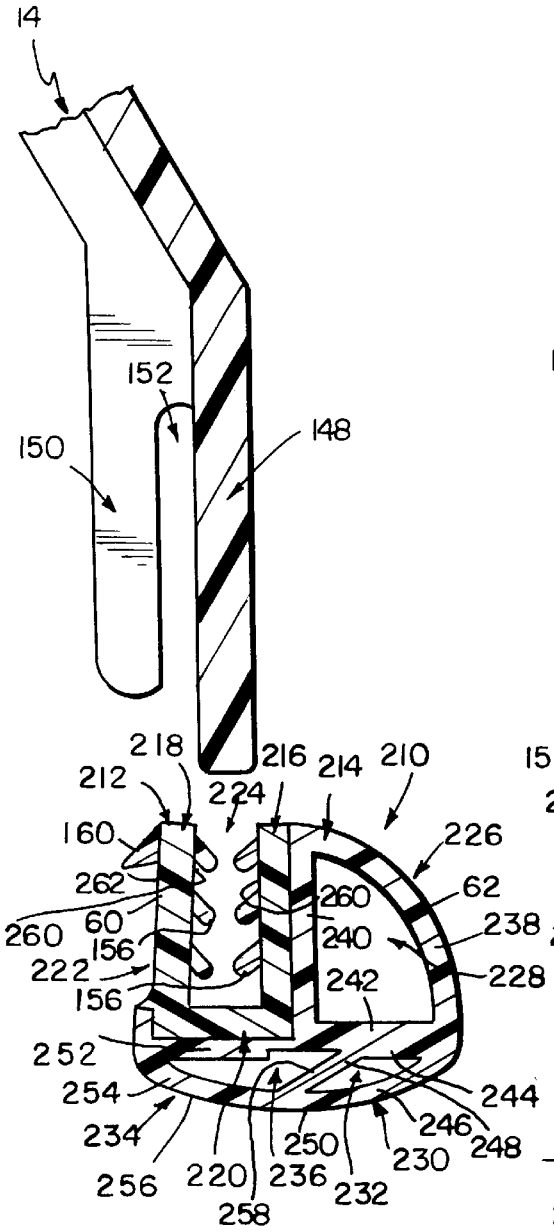
FIG. 12 is a cross-sectional view similar to FIG. 11 of another embodiment of a brake strip and a portion of the base member for use in the walker of FIG. 1 showing the brake strip prior to being mounted onto the base member.

An alternative embodiment of a brake strip 210 is shown separated from base member 14 in FIG. 12. Brake strip 210 includes a first or support portion 212 made of first material 60 and a second or brake portion 214 made of second material 62. Support portion 212 includes a first side or outer wall 216, a second side or inner wall 218, and a bottom wall 220 which cooperates with outer wall 216 and inner wall 218 to form a groove body 222 defining a groove 224. Brake portion 214 includes a first channel body 226 defining a first channel 228, a second channel body 230 defining a second channel 232, and a third channel body 234 defining a third channel 236. First channel body 226 is coupled to outer wall 216 of support portion 212, second channel body 230 is coupled to first and third channel bodies 226, 234, and third channel body 234 is coupled to bottom wall 220 of support portion 212.

First channel body 226 includes a first side wall 238, a second side wall 240 coupled to outer wall 216, and a bottom wall 242 as shown in FIG. 12. Second channel body 230 includes a top wall 244 coupled to bottom wall 242 of first channel body 226, a bottom wall 246 including a bottom or first contact surface 250, and a side wall 248 coupled to third channel body 234. Third channel body 234 includes a top wall 252 coupled to bottom wall 220 of support portion 212, a bottom wall 254 including a bottom or second contact surface 256, and a side wall 258 coupled to second channel body 230.

Figure 15:
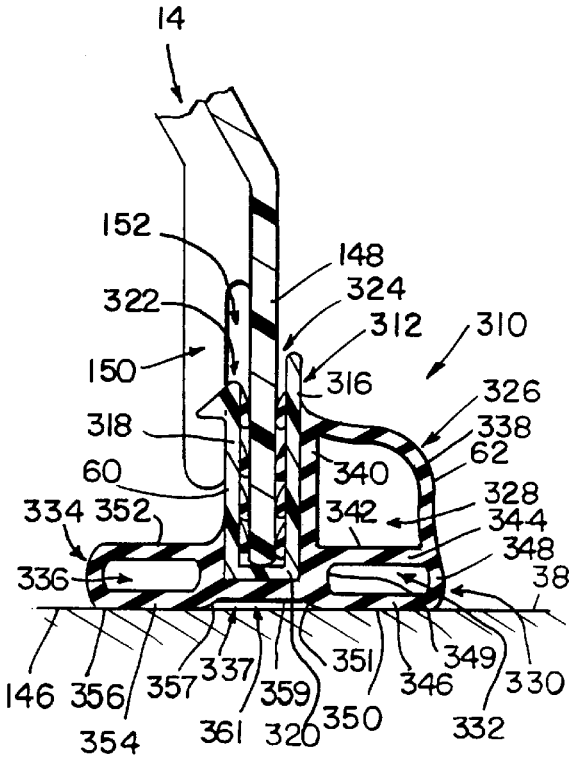
FIG. 15 is a view similar to FIG. 14 showing the brake strip mounted on to the base member and positioned to engage the step.

Because brake portion 214 of brake strip 210 is made of a soft low-durometer material, brake portion 214 conforms to more rigid objects applying force or pressure on first portion 212. For example, as shown in FIG. 15, brake portion 214 of brake strip 210 yields and conforms to normal force being applied against brake strip 210 by edge 146 of step 36. Such conforming of brake portion 214 allows brake strip 210 to form mechanical-like gripping contact between edge 146 and base unit 12 in addition to the static and dynamic frictional contact caused by normal forces applied by edge 146. Such frictional forces would also act against brake strip 210 if the contact was with a surface such as surface 38.

The mechanical-like gripping contact and the frictional forces provide resistance to force 78 applied to walker 10. Such contact with edge 146 of step 36 or surface 38 and the resulting resistance to the applied force are components in stopping movement of walker 10 if one of the caster wheels 28 or bidirectional wheels 70 loses contact with surface 38. Such a condition could exist, for example, if one of the caster wheels 28 or bidirectional wheels 70 rolls over step 36 below the level of surface 38 as shown, for example, in FIGS. 4–9.

First, second, and third channel bodies 226, 230, 234 of brake strip 210 permit additional cushioning and flexure of brake strip 210 when it contacts a surface such as edge 146 of step 36 or surface 38 to provide superior braking characteristics of walker 10. First, second, and third channel bodies 226, 230, 234 increase the flexibility of brake strip 210 and allow brake strip 210 to conform more to edge 146 or surface 38 as shown, for example, in FIG. 13 to increase the mechanical-like gripping contact between walker 10 and edge 146 of step 36 or surface 38.

Likewise, first and second contact surfaces 250, 256 are curved or bubble-shape as defined by second and third channel bodies 230, 234. This curved shape deforms when brake strip 210 engages edge 146 or surface 38. This deformation increases the area of contact of first and second contact surfaces 250, 256 with edge 146 or surface 38. An increased area of contact increases the gripping of brake strip 210 to edge 146 or surface 38 and helps resists motion of walker 10 against forces applied to walker 10. Furthermore, by providing a curved shape to first and second contact surfaces 250, 256 brake strip 210 provides more gripping contact between walker 10 and surface 38 or edge 146 in the event that one of caster wheels 28 or bidirectional wheels 70 were to roll over step 36.

Figure 13:
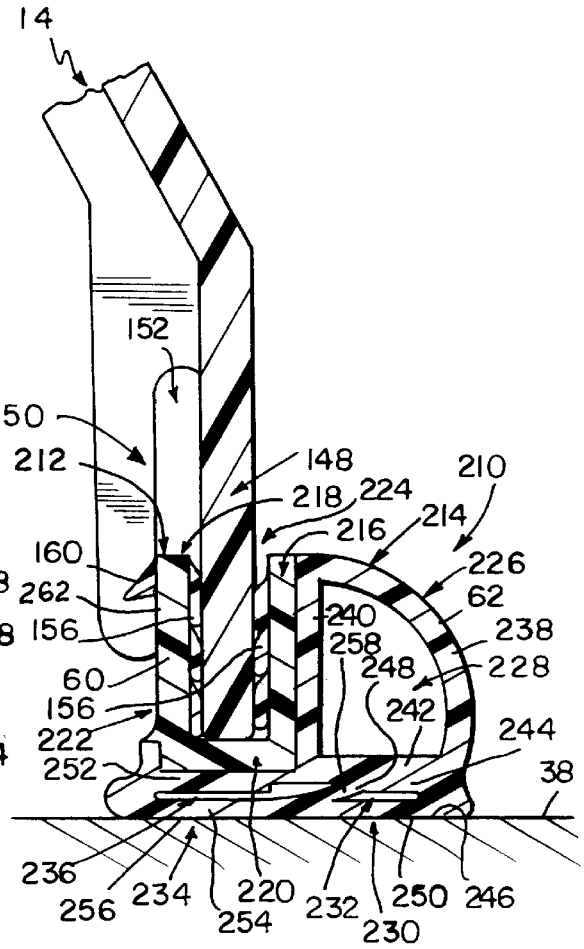
FIG. 13 is a view similar to FIG. 12 showing the brake strip mounted onto the base member and positioned to engage the step.

The mounting of brake strip 210 on lower peripheral edge 34 of base member 14 is shown in greater detail in FIGS. 12 and 13. As previously mentioned, brake strip 210 includes support portion 212 and brake portion 214 that is softer than support portion 212. Support portion 212 provides increased rigidity and forms a clip so that inner wall 218 of brake strip 210 can be "snapped" or "clipped" to hold on to base member 14 in a tight grip as shown in FIG. 13.

Brake portion 214 further includes series of inner tabs 156 coupled to an inner surface 260 of groove body 222 that extend into groove 224 and outer tabs 160 coupled to an outer surface 262 of groove body 222 and extending away from inner wall 218 as shown, for example in FIG. 12. Inner and outer tabs 156, 160 conform to base member 14 when brake strip 210 is clipped on to base member 14. Inner tabs 150 of base member 14 and outer wall 148 wedge and compress inner and outer tabs 156, 160 of brake strip 210 as shown, for example, in FIG. 13. Thus, the rigidity of support portion 212 provides a clip-like connection to base member 14 and inner tabs 156 of brake strip 210 compress against outer wall 148 of base member 14 to form a compression connection to base member 14 that couples brake strip 210 to base member 14 without the use of adhesives. However, it is within the scope of this disclosure for adhesives to be used to couple the brake strip to the base member. Likewise, outer tab 160 compresses against inner tabs 150 to form a compression connection to base member 14 that also couples brake strip 210 to base member 14.

Figure 14:
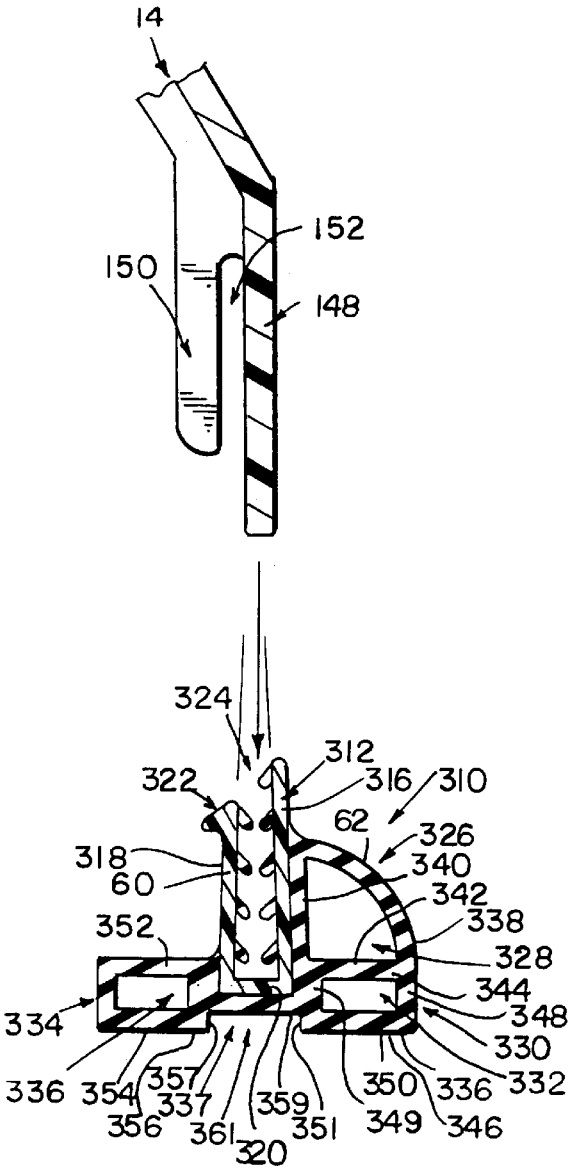
FIG. 14 is a cross-sectional view of yet another embodiment of a brake strip and a portion of the base member for use in the walker of FIG. 1 showing the brake strip prior to being mounted onto the base member.
Figure 16:
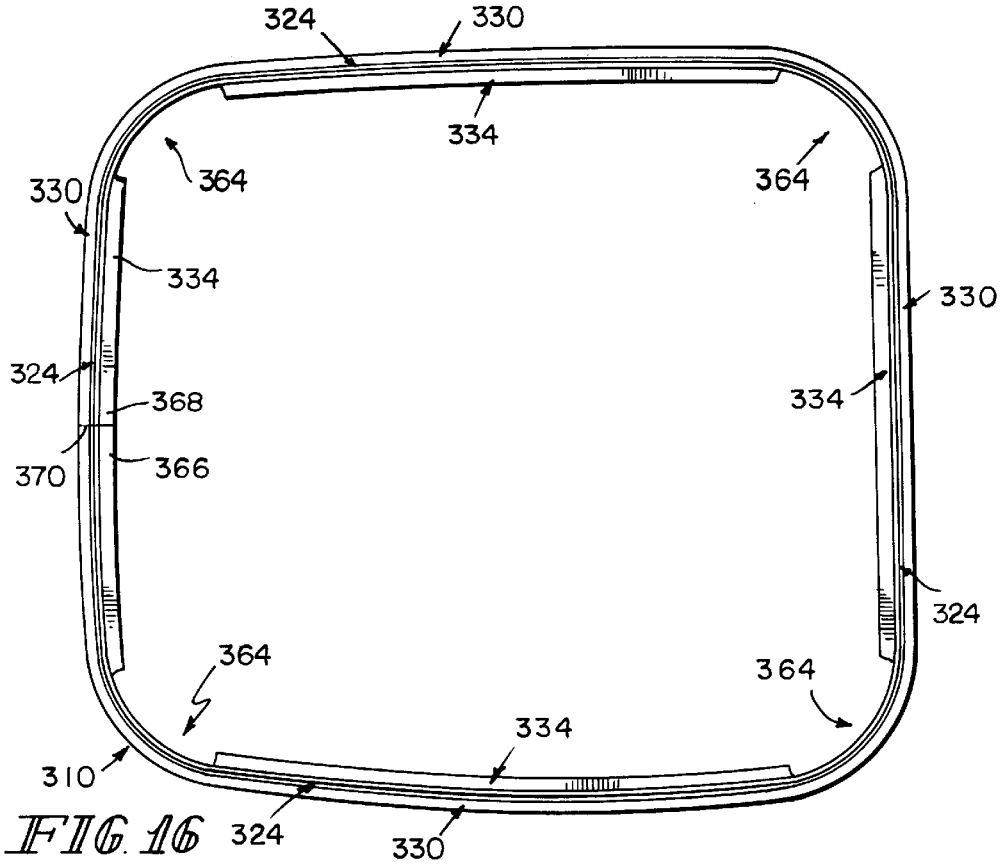
FIG. 16 is a top view of the brake strip of FIG. 14.
Figure 17:
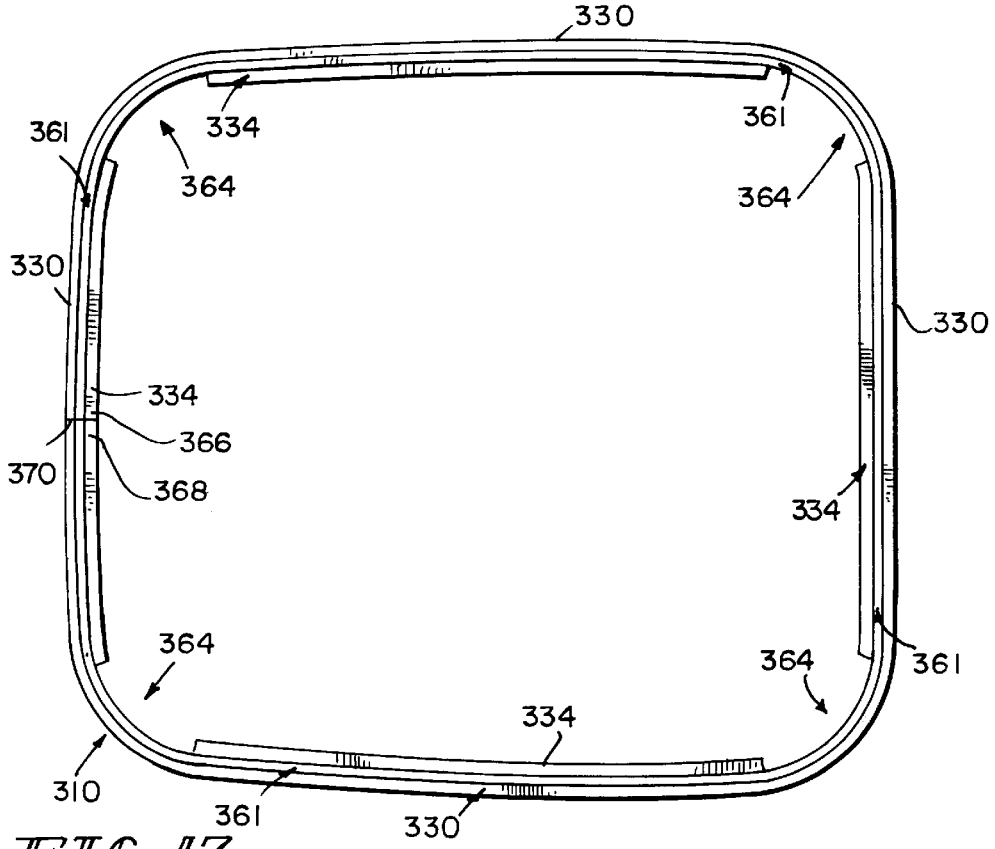
FIG. 17 is a bottom view of the brake strip of FIG. 14.

Yet another alternative embodiment of a brake strip 310 is shown separated from base member 14 in FIGS. 14, 16, and 17. Brake strip 310 includes a first or support portion 312 made of first material 60 and a second or brake portion 314 made of second material 62. Support portion 312 includes a first side or outer wall 316, a second side or inner wall 318, and a bottom wall 320 which cooperates with outer wall 316 and inner wall 318 to form a groove body 322 defining a groove 324. Brake portion 314 includes a first channel body 326 defining a first channel 328, a second channel body 330 defining a second channel 332, a third channel body 334 defining a third channel 336, and an extended body 337 extending between second channel body 330 and third channel body 334. First channel body 326 is coupled to outer wall 316 of support portion 312, second channel body 330 is coupled to first channel body 326 and extended body 337, third channel body 334 is coupled to inner wall 318 of support portion 312 and extended body 337, and extended body 337 is coupled to bottom wall 320 of support portion 312, second channel body 330, and third channel body 334.

First channel body 326 includes a first side wall 338, a second side wall 340 coupled to outer wall 316, and a bottom wall 342 as shown in FIG. 14. Second channel body 330 includes a top wall 344 coupled to bottom wall 342 of first channel body 326, a bottom wall 346 including a bottom or first contact surface 350 and first inner edge 351, a first side wall 348, and a second side wall 349 coupled to extended body 337 and outer wall 316. Third channel body 334 includes a top wall 352, a bottom wall 354 including a bottom or second contact surface 356 and a second inner edge 357, a first side wall 360, and a second side wall 358 coupled to extended body 337 and inner wall 318. Extended body 337 includes a bottom or third contact surface 359. Bottom surface 359, first inner edge 351, and second inner edge 357 defines a groove 361 as shown in FIG. 14.

Because brake portion 314 of brake strip 310 is made of a soft low-durometer material, brake portion 314 conforms to more rigid objects applying force or pressure on brake portion 314. For example, as shown in FIG. 15, brake portion 314 of brake strip 310 yields and conforms to normal force being applied against brake strip 310 by edge 146 of step 36. Such conforming of brake portion 314 allows brake strip 310 to form mechanical-like gripping contact between edge 146 and base unit 12 in addition to the static and dynamic frictional contact caused by normal forces applied by edge 146. Such frictional forces would also act against brake strip 310 if the contact was with a surface such as surface 38.

The mechanical-like gripping contact and the frictional forces provide resistance to force 78 applied to walker 10.

Such contact with edge 146 of step 36 or surface 38 and the resulting resistance to the applied force are components in stopping movement of walker 10 if one of the caster wheels 28 or bidirectional wheels 70 loses contact with surface 38. Such a condition could exist, for example, if one of the caster wheels 28 or bidirectional wheels 70 rolls over step 36 below the level of surface 38 as shown, for example, in FIGS. 4–9.

First, second, and third channel bodies 326, 330, 334 of brake strip 310 permit additional cushioning and flexure of brake strip 310 when it contacts a surface such as edge 146 of step 36 or surface 38 to provide superior braking characteristics of walker 10. First, second, and third channel bodies 326, 330, 334 increase the flexibility of brake strip 310 and allow brake strip 310 to conform more to edge 146 or surface 38 as shown, for example, in FIG. 15 to increase the mechanical-like gripping contact between walker 10 and edge 146 of step 36 or surface 38.

The deformation of second and third channel bodies 330, 334 increases the area of contact of first and second contact surfaces 350, 356 with edge 146 or surface 38. Similarly, because second and third channel bodies 330, 334 are flexible and deform when in contact with edge 146 or surface 38, extended body 337 engages edge 146 or surface 142 and third contact surface 359 contacts edge 146 or surface 142 and further increases the area of contact of brake strip 310 and increases the gripping force. An increased area of contact increases the gripping of brake strip 310 to edge 146 or surface 38 and helps resists motion of walker 10 against forces applied to walker 10.

Groove 361 also increases the degree of conformity of brake strip 310 by reducing the quantity of material in brake portion 314. By reducing the quantity of material, brake portion 314 becomes more flexible to further increase the gripping contact of brake strip 310. Groove 361 also provides separation between first and second contact surfaces 350, 356. By providing such separation, first and second contact surfaces 350, 356 provide at least two points of contact to grip with surface 38 or edge 146. Furthermore, if first and second contact surfaces 350, 356 were to "cup" upwardly away from surface 38 or edge 146, first and second contact surfaces 350, 356 would provide at least four contact points. By providing groove 361 with the corresponding increase in contact points, brake strip 310 provides more gripping contact between walker 10 and surface 38 or edge 146 in the event that one of caster wheels 28 or bidirectional wheels 70 were to roll over step 36.

The mounting of brake strip 310 on lower peripheral edge 34 of base member 14 is shown in greater detail in FIGS. 14 and 15. As previously mentioned, brake strip 310 includes support portion 312 and brake portion 314 that is softer than support portion 312. Support portion 312 provides increased rigidity and forms a clip so that inner wall 318 of brake strip 310 can be "snapped" or "clipped" to hold on to base member 14 in a tight grip as shown in FIG. 15.

Brake portion 314 further includes series of inner tabs 156 coupled to an inner surface 360 of groove body 322 that extend into groove 324 and outer tabs 160 coupled to an outer surface 362 of groove body 322 and extending away from inner wall 318 as shown, for example in FIG. 14. Inner and outer tabs 156, 160 conform to base member 14 when brake strip 310 is clipped on to base member 14. Inner tabs 150 of base member 14 and outer wall 148 wedge and compress inner and outer tabs 156, 160 of brake strip 310 as shown, for example, in FIG. 15. Thus, the rigidity of support portion 312 provides a clip-like connection to base member 14 and inner tabs 156 of brake strip 310 compress against outer wall 148 of base member 14 to form a compression connection to base member 14 that couples brake strip 310 to base member 14 without the use of adhesives. However, it is within the scope of this disclosure for adhesives to be used to couple the brake strip to the base member. Likewise, outer tab 160 compresses against inner tabs 150 to form a compression connection to base member 14 that also couples brake strip 310 to base member 14.

Brake strip 310 is also formed to include notches 364 corresponding to the corners of base member 14 as shown, for example, in FIGS. 16 and 17. Notches 364 aid in forming brake strip 310 around the corners of base member 14 during and after coupling of brake strip 310 to base member 14 to prevent brake strip 310 from "bunching" around the curve of the corners of base member 14.

Each brake strip 32, 210, 320 includes first and second ends 366, 368 that meet at a junction 370. Brake strip clip 154 is positioned at junction 370, as shown in FIGS. 1 and 2 to clip first and second ends 366, 368 to base member 14.

Although the invention has been described in detail with reference to certain embodiments, variations and modifications exist within the scope and spirit of the invention as described and as defined in the following claims.

What is claimed is:

1. A walker comprising a base unit, a support unit including a seat adapted to support a person, a frame unit coupled to the base unit and the support unit to suspend the support unit above the base unit, a pivot unit pivotably coupled to the base unit for movement about a pivot axis, at least one bidirectional wheel coupled to the pivot unit so that the at least one bidirectional wheel is constrained to roll back and forth along a straight line, and at least one caster wheel coupled to the base unit and spaced apart from the bidirectional wheel.

2. The walker of claim 1, wherein the seat includes a back support portion and a leg-receiving portion, the base member includes a front end arranged to lie in spaced-apart relation to the back support portion to position the leg-receiving portion therebetween, and the pivot unit is coupled to the front end.

3. The walker of claim 2, wherein the base member further includes a rear end arranged to lie in spaced-apart relation to the leg-receiving portion to position the back support portion therebetween and the at least one caster wheel is coupled to the rear end.

4. The walker of claim 1, wherein the base member includes a front end and a rear end arranged to lie in spaced-apart relation to the front end to position the seat therebetween, the pivot unit is coupled to the front end, and the at least one caster wheel is coupled to the rear end.

5. The walker of claim 4, wherein the rear end is formed to include first and second corner portions, a first caster wheel is coupled to the first corner portion, and a second caster wheel is coupled to the second corner portion.

6. The walker of claim 1, wherein each bidirectional wheel includes a support coupled to the pivot unit and a wheel member rotatably coupled to the support for rotation about an axis of rotation oriented to lie in perpendicular, non-intersecting relation to the pivot axis.

7. The walker of claim 6, wherein the pivot unit includes an arm having left and right ends and a center portion between the left and right ends and a pivot pin coupled to the base member and the center portion of the arm, a first of the two bidirectional wheels is coupled to the left end of the arm, and a second of the two bidirectional wheels is coupled to the right end of the arm.

8. The walker of claim 1, wherein the base unit includes a base member and a brake strip coupled to the base member, two bidirectional wheels are coupled to the base unit, and each bidirectional wheel includes a support coupled to the base unit and a wheel member rotatably coupled to the support for rotation about an axis of rotation, and the axis of rotation of the wheel member of a first of the bidirectional wheels is coextensive with the axis of rotation of the wheel member of a second of the bidirectional wheels.

9. The walker of claim 8, wherein the base member includes a front end and a rear end arranged to lie in spaced-apart relation to the front end to position the seat therebetween, the two bidirectional wheels are coupled to the front end, and two caster wheels are coupled to the rear end.

10. The walker of claim 1, wherein the base unit includes a base member formed to include a cavity and the pivot unit is coupled to the base member and positioned to lie in the cavity of the base member, the walker further includes another bidirectional wheel and another caster wheel, and the bidirectional wheels and the at least one caster wheel are positioned to lie in the cavity of the base member, and the bidirectional wheels are coupled to the pivot unit and the caster wheels are coupled to the base member.

11. A walker comprising a base unit, a support unit including a seat adapted to support a person, a frame unit coupled to the base unit and the support unit to suspend the support unit above the base unit, two bidirectional wheels coupled to the base unit through a pivot unit, each bidirectional wheel including a support coupled to the pivot unit and positioned to lie in spaced-apart relation to the other support and a wheel member rotatably coupled to the respective support for rotation about an axis of rotation, and the axis of rotation of the wheel member of a first of the bidirectional wheels being coextensive with the axis of rotation of the wheel member of a second of the bidirectional wheels, and at least one caster wheel coupled to the base unit and spaced apart from the bidirectional wheels.

12. A walker comprising a base unit including a base member and a pivot unit including an arm pivotably coupled to the base member, the arm including a first end and a second end spaced apart from the first end, a support unit including a seat adapted to support a person, a frame unit coupled to the base unit and the support unit to suspend the support unit above the base unit, two bidirectional wheels, one of the bidirectional wheels being coupled to the first end of the arm and the other bidirectional wheel being coupled to the second end of the arm so that each bidirectional wheel is constrained to roll back and forth along a straight line, and at least one caster wheel coupled to the base member and spaced apart from the bidirectional wheel.

13. The walker of claim 12 further comprising another caster wheel, and wherein the base member includes a front end and a rear end, the pivot unit is coupled to the front end of the base member, and the caster wheels are coupled to the rear end of the base member.

14. The walker of claim 12, wherein the bidirectional wheels include a base rigidly coupled to the arm and a pair of wheel members rotatably coupled to the base.

15. The walker of claim 14, wherein the wheel members of the bidirectional wheels are made of a soft material that increases the tackiness and surface-gripping ability of the wheel members.

16. A walker comprising a base member, a support unit including a seat adapted to support a person, a frame unit coupled to the base member and the support unit to suspend the support unit above the base member, a first pair of wheels coupled to the base member, a pivot unit pivotably coupled to the base member, and a pair of bidirectional wheels coupled to the pivot unit so that each bidirectional wheel is constrained to roll back and forth along a straight line.

17. The walker of claim 16, wherein the first pair of wheels are caster wheels.

18. The walker of claim 17, wherein the base member is formed to include a cavity and the caster wheels, the pivot unit, and the pair of bidirectional wheels are positioned to lie in the cavity.

19. The walker of claim 18, wherein the base member includes a front end and a rear end arranged to lie in spaced-apart relation to the front end to position the seat therebetween, the caster wheels are coupled to the rear end of the base member, and the pair of bidirectional wheels are coupled to the front end.

20. The walker of claim 16, wherein each of the pair of bidirectional wheels includes a base coupled to the pivot unit and a pair of wheel members coupled for rotation on the base.

21. The walker of claim 20, wherein the wheel members of the bidirectional wheels are made of a material that increases the tackiness and surface-gripping ability of the wheel members.

22. The walker of claim 16, wherein the base member includes a front end and a rear end arranged to lie in spaced-apart relation to the front end to position the seat therebetween, the pivot unit is coupled to the front end of the base member, and the first pair of wheels are coupled to the rear end of the base member.

23. A walker for movement over a floor, the walker comprising a base member and a brake strip coupled to the base member, the brake strip including a first portion made of a first material and a second portion made of a second material being softer than the first material, the first portion being coupled to the base member, and the second portion being adapted to engage the floor and resist movement of the walker when the brake strip engages the floor.

24. A walker comprising a base unit, a support unit including a seat adapted to support a person, a frame unit coupled to the base unit and the support unit to suspend the support unit above the base unit, at least one bidirectional wheel coupled to the base unit, and at least one caster wheel coupled to the base unit and spaced apart from the bidirectional wheel, the base unit including a base member and a brake strip coupled to the base member, the brake strip including a brake portion formed to include first and second channel bodies.

25. The walker of claim 24, wherein the brake strip includes a support portion having a side wall and the first channel body is coupled to the side wall, the first channel body includes a bottom wall, and the second channel body is coupled to the bottom wall of the first channel body.

26. The walker of claim 24, wherein the brake strip further includes a groove body made of a first material, the brake portion is made of a second material that is softer than the first material and the groove body is coupled to the base member and the brake portion is coupled to the groove body.

* * * * *